United States Patent [19]

Stegens et al.

[11] Patent Number: 4,591,812

[45] Date of Patent: May 27, 1986

[54] COPLANAR WAVEGUIDE QUADRATURE HYBRID HAVING SYMMETRICAL COUPLING CONDUCTORS FOR ELIMINATING SPURIOUS MODES

[75] Inventors: Ronald E. Stegens, Brookeville; Gary G. Hawisher, Germantown, both of Md.

[73] Assignee: Communications Satellite Corporation, Washington, D.C.

[21] Appl. No.: 443,833

[22] Filed: Nov. 22, 1982

[51] Int. Cl.[4] ..... H01P 5/18

[52] U.S. Cl. ..... 333/116; 333/246

[58] Field of Search ..... 333/116, 117, 128, 136, 333/246

[56] References Cited

U.S. PATENT DOCUMENTS 4,313,095 1/1982 Jean-Frederic ..... 333/116

FOREIGN PATENT DOCUMENTS 0086505 7/1981 Japan ..... 333/116

2071922 9/1981 United Kingdom ..... 333/116

*Primary Examiner*—Eugene R. LaRoche

*Assistant Examiner*—Benny Lee

*Attorney, Agent, or Firm*—Sughrue, Mion, Zinn, Macpeak, and Seas

[57] ABSTRACT

A coplanar waveguide quadrature hybrid is herein disclosed which produces even E-field symmetry about the center line of transmission during both even-and odd-mode excitation. In a first embodiment of the present invention, a first coupling element of a generally elongated shape is bifurcated and is interconnected at its ends to form a first rectangular coupling element. A second rectangular coupling element is disposed within the first rectangular coupling element. In a second embodiment of the present invention, one of the short sides of a first rectangular coupling element is broken and is cross-coupled to a third rectangular coupling element similar to the second rectangular coupling element, the third rectangular coupling element being disposed within a fourth rectangular coupling element similar to the first coupling element. The fourth rectangular coupling element is then directly connected to the second rectangular element to form a composite coupling element. During odd-mode excitation, the resulting CPW structures do not create an E-field between the ground planes and thus eliminate the spurious "slot-line" mode of operation of prior art CPW devices.

9 Claims, 8 Drawing Figures

COPLANAR WAVEGUIDE QUADRATURE HYBRID HAVING SYMMETRICAL COUPLING CONDUCTORS FOR ELIMINATING SPURIOUS MODES

BACKGROUND OF THE INVENTION

The present invention relates generally to coplanar waveguide, quadrature hybrids and is specifically designed to eliminate unwanted electromagnetic couplings between the ground planes of such devices.

In the article "Coplanar Waveguide: A Surface Strip Transmission Line Suitable for Nonreciprocal Gyromagnetic Device Applications", *IEEE MTT*, December 1969 (MTT-17, #12) pg. 1087 ff., C. P. Wen first proposed the basic coplanar waveguide coupled-line configuration as shown in FIGS. 1A and 1B. In FIG. 1B, coplanar waveguide (CPW) 10 comprises a first ground plane 1, coupled transmission lines 2 and 3, and a second ground plane 4, all of which are printed upon the same surface 6 of a dielectric substrate 5. The CPW lines of FIG. 1B can operate either in the even mode (i.e. the voltages and currents of one of the transmission elements are in phase with those of the other transmission element) or in the odd mode (i.e. the voltages and currents of one of the transmission elements are 180° out of phase with those of the other transmission element). The length of the coupled (or parallel) sections of the transmission elements as shown in FIG. 1A is chosen to be 90 electrical degrees (one quarter wavelength) at the operating frequency.

Referring back to FIG. 1B, note that the evenmode impedance Zoe, the odd-mode impedance Zoo, and the coupling coefficients between the coupled sections of the transmitters, can all be altered by changing any of the length parameters a, b or c, where length "a" is the distance between the center line of transmission 20 and the abutting edge of a coupling element, length "b" is the distance between the center line of transmission and the non-abutting edge of a coupling element, and length "c" is the distance between the center line of transmission and the abutting edge of a ground plane.

The CPW device as described above is well suited for a variety of microstrip waveguide device applications. However, when the CPW of FIGS. 1A and 1B is excited in the odd mode, spurious electric fields are propagated between the ground planes of the device. With reference to FIG. 2, when the device of FIGS. 1A and 1B operates in the odd mode (i.e. the instantaneous voltages and currents in the coupling sections are of opposite sign), the naturally occurring electric field (as shown by the solid arrows) is not symmetrical about the center line of transmission 20. Accordingly, a spurious E-field (as shown by the dashed arrow) develops between the ground planes 1 and 4, producing a potential difference between the ground planes. This spurious "slot-line" propagation mode operates differently then the normal CPW propagation mode, and such a multimoded operation is extremely detrimental to the operation of the coupler. Specifically, this spurious propagation mode makes CPW design difficult, since analysis of the performance of the coupler can only be undertaken assuming that all propagation takes place in a single mode, requiring both ground planes to be at the same potential.

SUMMARY OF THE INVENTION

It is thus an object of the present invention to produce a coplanar waveguide quadrature hybrid in which spurious electromagnetic fields between the ground planes are eliminated.

It is a further object of the present invention to produce a coplanar waveguide quadrature hybrid which operates only in the CPW mode when its coupling elements are excited in either the odd mode or the even mode.

It is another object of the present invention to produce a coplanar waveguide quadrature hybrid which has an even E-field symmetry about its center line of transmission in either the even or odd mode.

It is yet a further object of the present invention to produce a coplanar waveguide quadrature hybrid in which tight coupling (i.e. a large coupling coefficient) is readily realized.

It is yet another object of the present invention to produce a coplanar waveguide quadrature hybrid in which equal capacitive coupling exists between each coupling element and the associated ground planes.

The foregoing and other objects of the present invention are realized in a device having first and second coupling elements by bifurcating the second coupling element and connecting its two ends to form a rectangle. The first coupling element is disposed along the width center line of the first rectangular coupling element. The lengths of the long sides of both the first and second coupling elements are 90° ($\lambda/4$) in length at the center frequency of operation. In an alternative embodiment of the present invention, one of the short sides of the second coupling element is broken and is cross-coupled to a third coupling similar in structure to the first coupling element, the third coupling element being disposed within an unbroken fourth coupling element similar in structure to the second coupling element. During odd-mode excitation, the resulting waveguides produce an even E-field symmetry about the center line of transmission, thus eliminating spurious E-fields between the ground planes.

BRIEF DESCRIPTION OF THE DRAWINGS

The structures and functions of the present invention will become more apparent upon a detailed description of the preferred embodiments thereof. In the description to follow, reference will be made to the accompanying drawings, in which.

DETAILED DESCRIPTION OF THE PREFERRED EMBODIMENTS

Figure 1A:
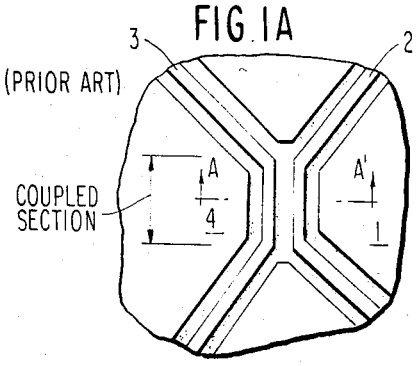
FIG. 1A (PRIOR ART)
FIG. 1A is a top side view of a coplanar waveguide hybrid of the prior art.
Figure 1B:
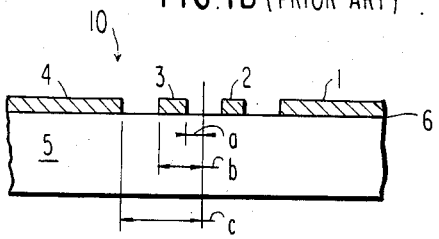
FIG. 1B (PRIOR ART)
FIG. 1B is a cross-sectional view of a coplanar waveguide hybrid of the prior art, taken along A—A' of FIG. 1A.
Figure 2:
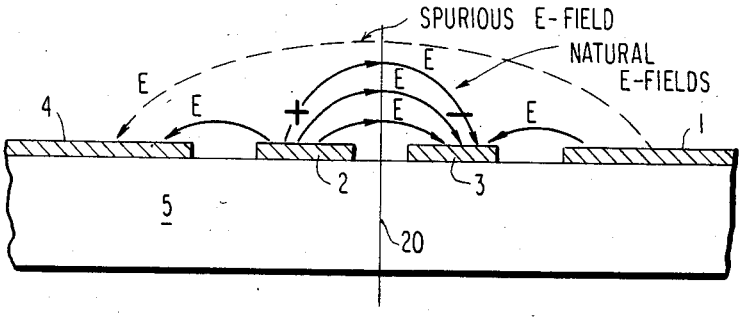
FIG. 2 (PRIOR ART)
FIG. 2 is a cross-sectional view of a coplanar waveguide hybrid of the prior art excited in the odd mode.
Figure 3A:
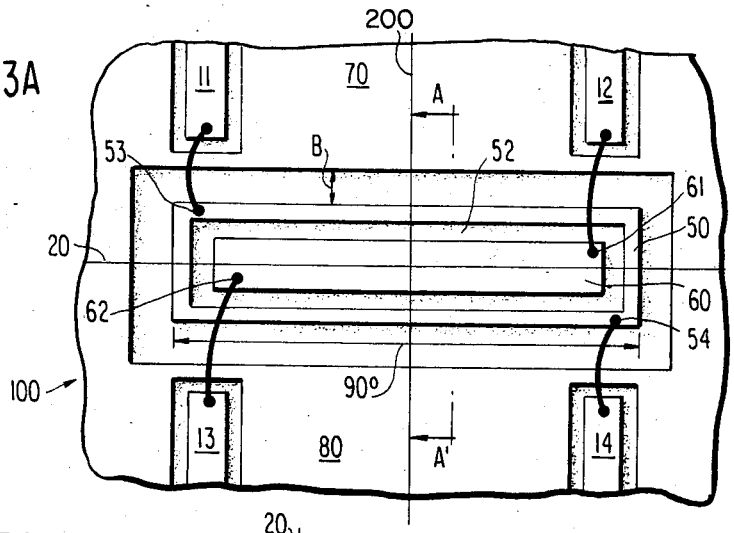
FIG. 3A is a top side view of first embodiment of the present invention.

A first embodiment of the present invention will now be described with reference to FIGS. 3A and 3B. In FIG. 3A, quadrature hybrid coplanar waveguide 100 comprises input ports 11 and 12 and output ports 13 and 14 and first and second coupling elements 60 and 50, respectively. Second coupling element 50 is of elongated shape. The ends of the coupling element 50 are interconnected such that the coupling element 50 defines an inner rectangular region 52 of dielectric substrate. Coupling element 50 is disposed such that input ports 11 and 12 abut one of its long sides and output ports 13 and 14 abut the other of its long sides. Each long side is 90°(one quarter wavelength) in length at the center frequency of operation.

Disposed within the dielectric region 52 and centered upon the center line of transmission 20 is the first rectangular coupling element 60. This rectangular coupling element 60 is of a solid configuration. As is the case with the coupling element 50, rectangular coupling element 60 is 90° in length at the center frequency of operation. Both the second rectangular coupling element 50 and the first rectangular coupling element 60 are further surrounded by two ground planes 70 and 80 which are disposed a distance B from the rectangular coupling element 50.

In a CPW coupler as shown in FIG. 3A, there are two coupling conductors 50 and 60. Each of the coupling conductors is connected at its opposite ends to two different ports. Accordingly, a signal will be "transmitted" along each coupling conductor between its connection points. In the arrangement of FIG. 3A, the connection points are at the left and right ends of the coupling conductors, so that the direction of "transmission" in the coupler will be from right-to-left or left-to-right in FIG. 3A. As used throughout this specification and the appended claims, the term "center line of transmission" refers to a line passing in the direction of signal transmission, i.e., generally between the connection points of each coupling conductor, and a line about which each of the coupling conductors are symmetrically disposed.

Figure 3B:
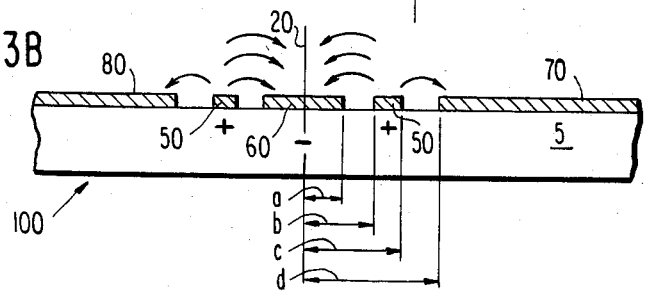
FIG. 3B is a cross-sectional view of an embodiment of the present invention, taken along line A—A' of FIG. 3A.

Referring now to FIG. 3B, the odd-mode operation of the first embodiment of the present invention will be described. As is apparent from FIG. 3B, during odd-mode excitation of the waveguide of the present invention, the electromagnetic field vectors are symmetrical about the center line of operation 20 of the waveguide 100. Since the E-field is symmetrical, no spurious ground plane couplings are produced which will unbalance the ground plane potentials, eliminating the spurious "slot-line" propagation mode produced during the odd-mode excitation of the CPWs of the prior art. Further, the E-field of the present invention is of even symmetry; that is, no electro-magnetic fields are propagated across the center line of operation 20. By eliminating the spurious slot-line mode propagation of the prior art, the performance of the CPW of the present invention will be entirely in the "CPW" mode and can be more readily predicted.

A variety of connecting schemes are possible for providing electric feed between the ports and the coupling elements of the present invention. In the first embodiment of the present invention as shown in FIG. 3A, input port 11 is wire bonded to a first corner 53 of peripheral coupling element 50, and output port 14 is wire bonded to a second corner 54 of peripheral coupling element 50 which is diagonally opposed to the first corner. The other input port 12 is wire bonded to a first corner 61 of the rectangular coupling element 60, and output port 13 is connected to a second corner 62 of the rectangular coupling element 60 diagonally opposed to the first corner of rectangular coupling element 60. As is well-known, only one of the "input" ports, e.g., port 11, will receive an input signal from an external source, the other port, e.g., port 12, will operate as an "isolation" port.

A second embodiment of the present invention will now be described with reference to FIG. 4, in which two abutting second rectangular coupling element portion 50 and 50' are disposed end-to-end within a dielectric 40. The second rectangular coupling element portion 50' is directly connected to the first rectangular coupling element portion 60, forming a composite coupling element 90. Also, a short side of first coupling element portion 50 is broken off, and the broken ends are cross coupled by lines 57 and 58 to first coupling element portion 60'. Input pad 11 is wire bonded to rectangular coupling element portion 50 at point 55 and isolation pad 12 is wire bonded to composite coupling element 90' at point 55'. Output port 13 is wire bonded to composite coupling element 90 at point 56, and output port 14 is wire bonded to the rectangular coupling element portion 60' at point 56'.

Figure 4:
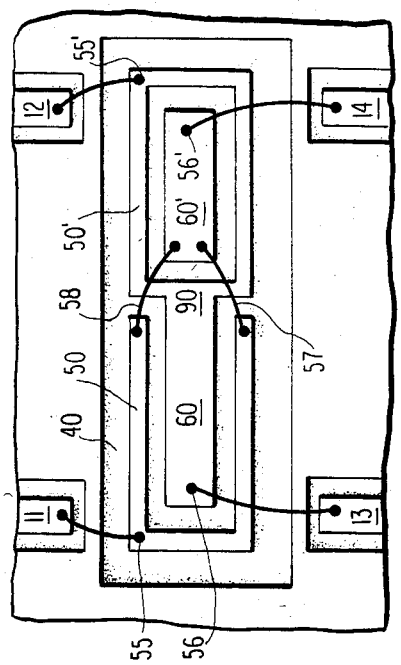
FIG. 4 is a top side view of a second embodiment of the present invention.

As can be seen from the above, the embodiments of FIGS. 3B and 4 are similar in that, in both cases, the second coupling conductor 50 (FIG. 3B) or 50, 50' (FIG. 4) is disposed symmetrically with respect to the center line of transmission 20. The first coupling conductor 60 (FIG. 3B) or 60, 60' (FIG. 4) is also disposed symmetrically with respect to the center line of transmission 20. In the preferred embodiments of FIGS. 3B and 4, the coupling conductors are also disposed symmetrically about a further line 200 which is perpendicular to the center line of transmission 20.

With reference to FIG. 3B, both the coupling coefficients and the odd- and even-mode impedances Zoo and Zoe of the present invention can be altered by varying a set of dimension ratios a/d, b/d and c/d as described in related U.S. patent application Ser. No. 227,466, "Symmetrical Coupled Line Coplanar Waveguide Filter", filed June 25, 1981 by the present applicant and assigned to the assignee of the present invention, which is herein incorporated by reference. The length l of the long sides of the rectangular coupling elements can be computed from the relation $$l = \frac{11.811}{4F(\text{GHz})\frac{\sqrt{e_r + 1}}{2}} \text{ inches,}$$

and the voltage coupling coefficient k can be computed from the even- and odd-mode impedances as $$k = \frac{(Zoe/Zoo) - 1}{(Zoe/Zoo) + 1} \tag{11}$$

where the coupling will be matched to source and load impedances such that $$Zo = \sqrt{Zoe \cdot Zoo}\ . \tag{12}$$

Figure 5:
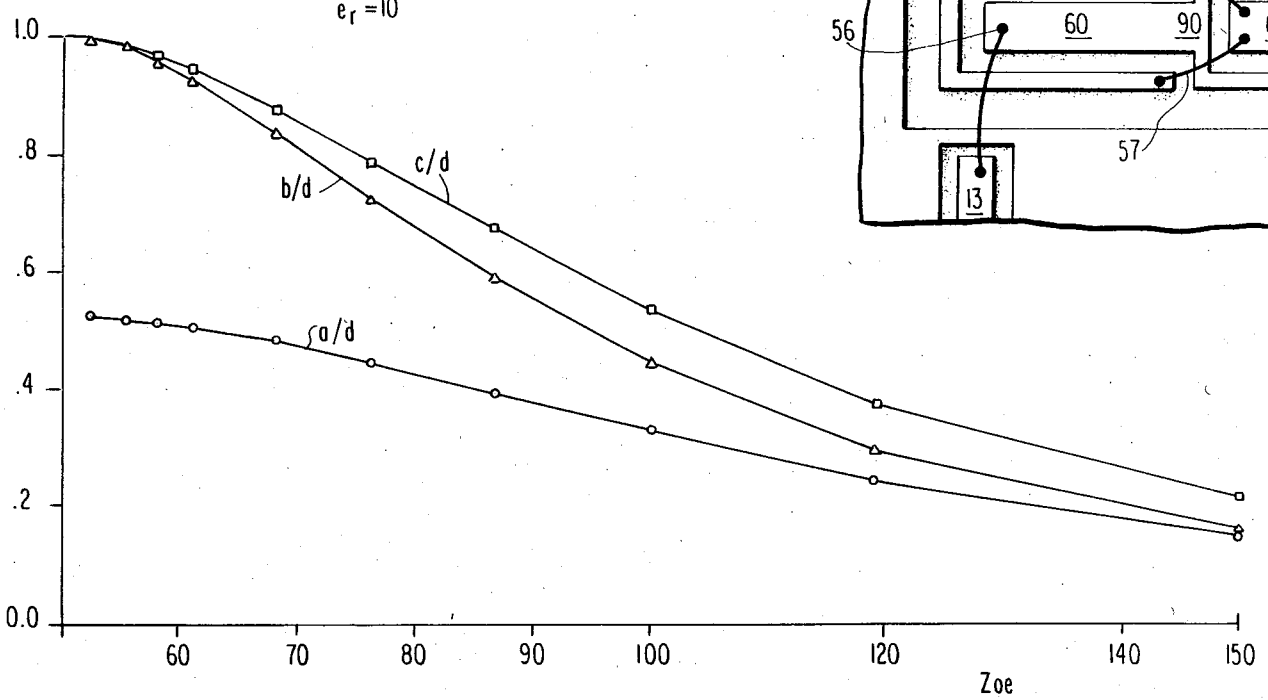
FIG. 5 is a graph of the various dimensions of the CPW of the present invention with respect to the odd-mode impedances of the present invention.

FIG. 5 is a graph of computed values for the ratios a/d, b/d and c/d for a given odd-mode impedance Zoo where Zo=50 ohms and $e_r$ (dielectric constant)=10.

The second embodiment of the present invention was tested for 3 dB performance for fo=4 GHz. The values of the various CPW parameters were as follows:

Zoe=120.7 ohms
Zoo=20.7 ohms
a/d=0.24
b/d=0.288
c/d=0.365
d=0.02"
90° length=0.315"

Figure 6:
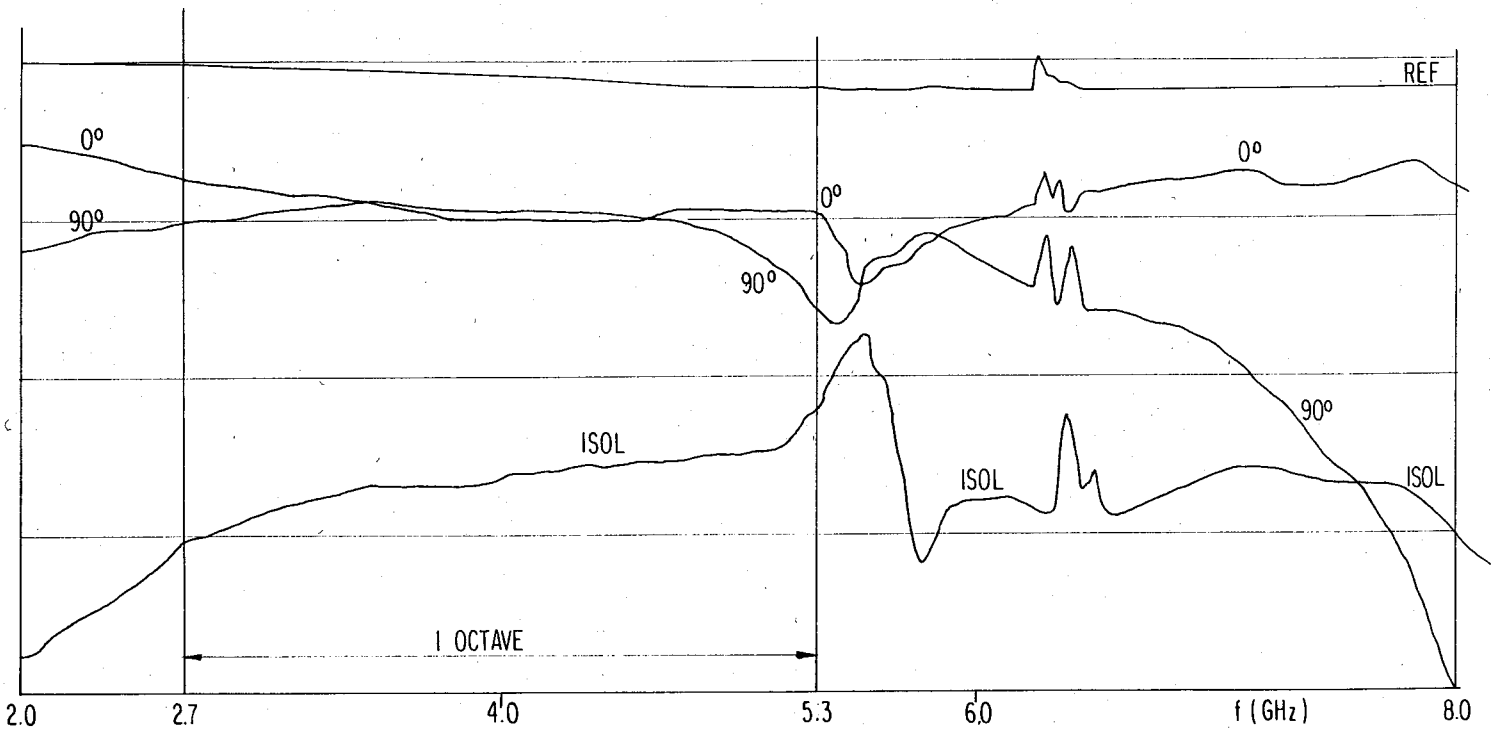
FIG. 6 is a graph of the response of the second embodiment of the present invention where fo=4 GHz.

The measured results using the second embodiment of the present invention are shown in FIG. 6. In the one-octave frequency region (2.7–5.3 GHz) around 4 GHz, an equal power split was obtained with an indicated loss of ≅ 1 dB due to thin metallization. Relative phase in this region of the two outputs was 90°, as expected. Power at the "isolated" port 12 was only 15 dB down, due to significant mismatches at the bond wires connecting the output CPW lines to the coupler.

In summary, a quadrature hybrid CPW has been described which produces an even E-field symmetry about the center line of transmission during both even- and odd-mode excitation. Such a device operates with more reliability than the CPW hybrid of the prior art, and thus can be utilized in a wider range of waveguide applications. Specifically, in addition to providing good performance, this new quadrature hybrid has several unique and useful features:

Large "k" values—i.e. tight coupling—is easily achieved using only two conductors; interdigitated lines are not required.

The width "d" in FIG. 3 may be chosen freely. Thus, the width may be made very small.

Because even and odd mode phase velocities are more nearly equal than is the case for microstrip hybrids, a potential exists for high directivity values.

Further independent compensation of phase velocities is easily accomplished by adjusting the separation between ground plane and line "B" at the ends of the coupler, or between the ends of lines "A" and "B."

Multiple cascades of such 90° structures can easily be designed which produce constant coupling over many octaves of bandwidth. This is possible because dimension "d" can be chosen arbitrarily small, with additional sections then added above and below the portion shown in FIG. 3A.

It is to be understood that modifications can be made to the present invention as described above, without departing from the spirit and scope of the invention as defined in the appended claims.

We claim:

1. A coplanar waveguide quadrature hybrid of the type comprising a dielectric substrate, a pair of first conductors, including an input conductor and an isolation conductor, and first and second output conductors, all formed on a surface of said substrate and disposed between grounded conductors also formed on said surface, and coupling means formed on said surface for coupling together said input, isolation and output conductors, said coupling means having a center line of transmission, the improvement characterized in that said coupling means comprises:

a first coupling conductor disposed on said substrate surface and electrically connected to said first output conductor and one of said first conductors; and a second coupling conductor disposed on said substrate surface and electrically connected to the other of said first conductors and to said second output conductor, said second coupling conductor surrounding at least a portion of said first coupling conductor;

each of said first and second coupling conductors being symmetrically disposed with respect to said center line of transmission.

2. The coplanar waveguide quadrature hybrid as recited in claim 1, wherein said first coupling conductor is electrically connected to said isolation conductor, and wherein said second coupling conductor is electrically connected to said input conductor.

3. The coplanar waveguide quadrature hybrid as recited in claim 1, wherein said first coupling conductor is electrically connected to said input conductor, and wherein said second coupling conductor is electrically connected to said isolation conductor.

4. The coplanar waveguide quadrature hybrid as recited in either claim 1 or claim 2, wherein said second coupling conductor surrounds all of said first coupling conductor.

5. The coplanar waveguide quadrature hybrid as recited in claim 1, wherein said first coupling conductor comprises a first portion and a bifurcated second portion electrically connected to said first portion, and wherein said second coupling conductor comprises a third portion substantially surrounded by said bifurcated second portion of said first coupling conductor and a bifurcated fourth portion electrically connected to said third portion and substantially surrounding said first portion.

6. The coplanar waveguide quadrature hybrid as recited in claim 5, wherein said first and second portions of said first coupling conductor comprise a single piece of conductive material disposed on said substrate surface, and wherein said third and fourth portions of said second coupling conductor comprise separate conductive pieces, said second coupling conductor further comprising crossover connection means for crossing over said first coupling conductor to electrically connect said third and fourth portions.

7. The coplanar waveguide quadrature hybrid of claim 4, wherein both of said first coupling conductor and said second coupling conductor are of generally rectangular configuration.

8. The coplanar waveguide quadrature hybrid as recited in claim 2, wherein said isolation conductor is electrically connected to a first corner of said first coupling conductor and wherein said input conductor is electrically connected to a first corner of said second coupling conductor opposite side first corner of said first coupling conductor.

9. The coplanar waveguide quandrature hybrid as recited in claim 1 or claim 5, wherein said first coupling conductor and said second coupling conductor are symmetrically disposed not only with respect to said center line of transmission but also with respect to a further line perpendicular to said center line of transmission, and wherein said input conductor, said isolation conductor and said output conductors are collectively disposed symmetrically with respect to said further line.

* * * * *